United States Patent [19]

Kerff

[11] 3,952,554

[45] Apr. 27, 1976

[54] YARN FEED STOP MOTION

[75] Inventor: Anton Kerff, Ulricehamn, Sweden

[73] Assignee: Aktiebolaget IRO, Ulricehamn, Sweden

[22] Filed: Dec. 27, 1974

[21] Appl. No.: 536,900

[30] Foreign Application Priority Data

Dec. 28, 1973 Sweden ..... 73-17606

[52] U.S. Cl. ..... 66/163; 200/61.13; 28/51

[51] Int. Cl.[2] ..... D04B 35/10

[58] Field of Search ..... 66/163, 161, 157, 132 R; 200/61.13, 61.15, 61.18; 340/419; 28/51; 139/353, 354; 19/.25, .26

[56] References Cited

UNITED STATES PATENTS 3,343,158 9/1967 Tellerman ..... 340/419

*Primary Examiner*—Mervin Stein
*Assistant Examiner*—Andrew M. Falik
*Attorney, Agent, or Firm*—Woodhams, Blanchard and Flynn

[57] ABSTRACT

A control device for a textile machine, in particular for a knitting machine having at least one yarn feeding device, with each yarn feeding device being provided with two stop-motion devices each respectively having an electrical stop-motion switch associated therewith. The stop-motion switches of the yarn feeding device are connected to a rectifier circuit such that the two stop-motion switches of the yarn feeding device are supplied with voltage half-waves of different polarity. A control unit is provided which is common to all stop-motion switches and which is capable of surpressing voltage half-waves of one polarity in order to neutralize the stop-motion switch supplied with the voltage halfwaves of said one polarity with reference to a relay which stops the mechanical drive of the textile machine.

5 Claims, 3 Drawing Figures

YARN FEED STOP MOTION

FIELD OF THE INVENTION

This invention relates to a control device for a textile machine, in particular a knitting machine, with one or more yarn feeding devices, for each of which there are provided a first and a second yarn stop motion device, each of which is arranged when being released to activate a relay through a conductor, common for all yarn stop motion devices and connected to a central alternating-current source, which relay is connected to a central alternating-current source, which relay is connected to the driving means of the machine, for stopping the machine.

BACKGROUND OF THE INVENTION

Generally the above-mentioned yarn stop motion devices are arranged on the input side and output side respectively of the yarn feeding device and are therefore called input stop motion device and output stop motion device respectively. As a rule the input stop motion device is arranged to be released in case of a yarn break as well as in cases when the yarn tension for one reason or another, e.g. when a yarn package of low quality is used, temporarily reaches values which are unacceptably high for the function of the yarn feeding device. The output stop motion device is likewise arranged to be released in case of a yarn break but is thereby often so adjusted that it is also released in case of yarn tension decreases caused by overfeeding of yarn, a feeder plugged with lint at the working place of the machine or by a tangle that becomes untangled on the path between the yarn feeding device and the working place of the machine.

A known control device of the kind mentioned in the introductory part comprises a number, which corresponds to the number of yarn feeding devices arranged on the machine, of electric circuits which are contained in the yarn feeding devices and each of which consists of the contacts of a first and a second yarn stop motion device, an indicator lamp for optic indication of one or both yarn stop motion devices being released and a diode. In both stop motion devices one contact terminal is connected to ground, whereas the other contact terminal of the first yarn stop motion device is connected to the corresponding contact terminal of the other yarn stop motion device. Both the last-mentioned contact terminals are furthermore connected to the above-mentioned indicator lamp as well as to the anode of the previously mentioned diode. The cathode of this diode is connected through the coil of a relay to one terminal of an alternating-current source, usually the secondary coil of a transformer. To the same terminal of the alternating-current source the indicator lamp is also connected, although direct. The other terminal of the alternating-current source is connected to ground, whereby the above described known control circuit constitutes a closed electric circuit. The contact of the above-mentioned relay is contained in the ordinary control circuit of the machine for stopping the driving motor of the textile machine. When the first or the second yarn stop motion device of one or more of the yarn feeding devices arranged on the machine is mechanically released, the relating contact — or contacts — is closed, whereby the indicator lamp is traversed by current and lights up. The purpose of the above-mentioned diode is to prevent the indicator lamp of one yarn feeding device from lighting by the "release current" from adjacent yarn feeding devices. Simultaneously with the above lighting of the indicator lamp the relay coil is activated, whereby the driving motor of the machine immediately is stopped.

Normally both yarn stop motion devices shall, of course, when being released, immediately make the machine stop. This has, however, proved that on a number of occasions there is an extraordinarily keen desire for the possibility of putting the first or the second yarn stop motion device temporarily out of operation. As an example this "switching off possibility" would be very desirable on the following occasions:

Adjustment of the switch cams of the machine;

Synchronization of the yarn speed with the machine speed;

Start of the machine after elimination of yarn breaks, after yarn change in the machine or after change of knitting bindings.

All these are examples of occasions when overfeeding of yarn arises more or less temporarily.

With the above described known control device, where the power supply to the driving motor of the machine would be blocked on all above-mentioned occasions every now and then, you must drive the machine by hand till the temporary overfeeding has disappeared and the blocking mentioned thereby has been raised.

The object of this invention is therefore to create a control device of the kind mentioned in the introductory part, where all first and second yarn stop motion devices can be put out of operation centrally by very simple means, preferably temporarily.

According to the invention this is achieved by the fact that the control device comprises means for achieving that all first and second yarn stop motion devices when being released only are traversed by the positive and the negative half-cycles respectively of the current through them, or vice versa, and means for enabling a central blocking of the positive or negative half-cycles of said current.

DETAILED DESCRIPTION

Figure 2:
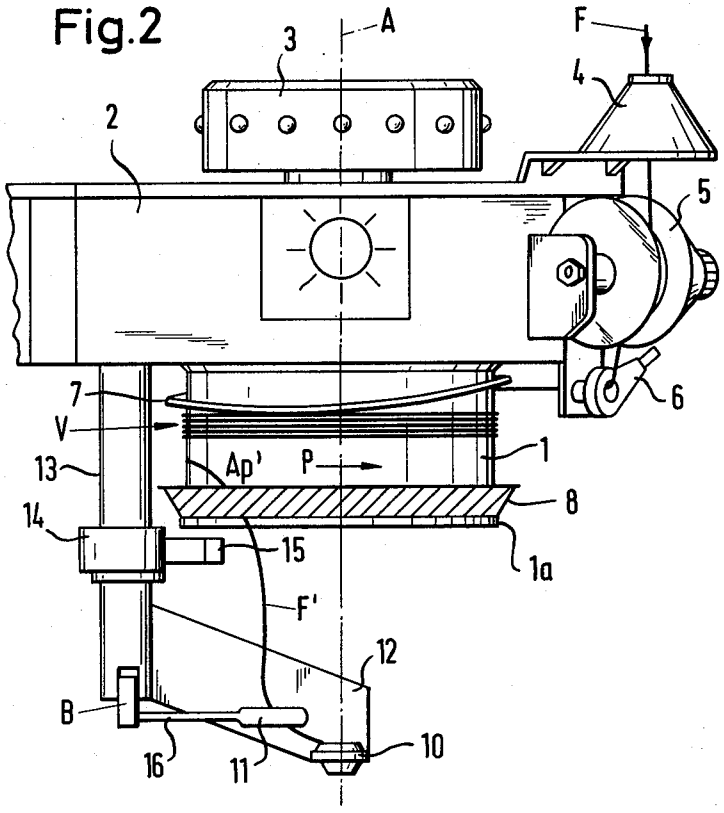
FIG. 2 shows the yarn feeding device according to FIG. 1 in a position during an inadmissibly high reduction in the yarn tension on the output of the feeder.

Numeral 1 designates a drum which is rotatably journalled in a housing 2. The housing 2 is secured to a textile machine, in particular a knitting machine, by means which are not shown in the Figure, and a plurality of such yarn feeding devices are provided corresponding to the number of knitting systems in the knitting machine. The drum 1 is driven via a pin wheel 3 and a perforated belt (not shown) which co-operates with the pin wheel and which is driven synchronously with the textile machine. The yarn F runs from a yarn package (not shown), passes through a ball brake 4, a disc brake 5 and a pivotable yarn stop motion device 6 to be wound tangentially onto the drum 1 which rotates in the direction indicated by the arrow P. The drum 1 is associated with an inclined displacement disc 7, which displaces the yarn windings which are formed in the axial direction on the drum so that an intermediate yarn reservoir V is formed thereon. The yarn is unwound from the reservoir V through a yarn brake ring 8 in vertical direction and over a lower withdrawal rim 1*a* of the drum 1. The unwinding yarn F′ passes through a withdrawal eyelet assembly shown by numeral 9 in FIG. 1. This consists of a stationary withdrawal eyelet 10, which is located on the imaginary axis A of the drum, and of a stop motion eyelet 11 which is the thread eyelet first reached by the unwinding yarn F′ after leaving the withdrawal rim 1*a*. From the withdrawal eyelet 10, the yarn arrives at one of the knitting stations of the machine. The withdrawal eyelet 10 is journalled at the free end of a support arm 12 secured to a support rod 13 which extends outside the drum 1 parallel to the imaginary axis A thereof and which is mounted in the housing 2 at its other end.

Directly below the withdrawal rim 1*a*, there is provided a hook 15 which is journalled on the support rod 13 by means of a hub 14, which hook 15 can be pivoted about an axis in the plane of the drawing from the position shown in the drawing, in which the mouth of the hook, which is open towards the viewer of the drawing, projects into the path of the yarn F′, into a position in which it does not project into the path of the unwinding yarn. This pivotability serves to switch over the feeder from a positive feed mode to an intermittent yarn withdrawal mode.

The stop motion eyelet 11 is positioned on a pivotal arm 16 which is urged by a spring (not shown), such that the eyelet 11 tends to pivot clockwise (seen in a top elevation view) about an axis B, i.e. out of the plane of the drawing towards the viewer.

During the withdrawal the yarn is removed vertically from the bottom of the drum 1. The speed of withdrawal and the speed of rotation of the drum 1 are coordinated so that the unwinding yarn F′ has a slight tendency to travel along the withdrawal rim 1*a* — imagined as being stationary — contrary to the direction of rotation P of the drum. The hook 15, however, is in the path of this movement, so that the location at which the yarn F′ leaves the withdrawal rim 1*a* is normally fixed in space. This normal point of withdrawal is shown as Ap in FIG. 1. It lies directly above the hook 15. By maintaining the point of withdrawal Ap contrary to the direction of drum rotation, only that amount of yarn may be unwound from the drum 1 as is released during rotation of the drum at the point of withdrawal Ap above the hook 15. This ensures positive feeding of the yarn.

The withdrawal tension present in the unwinding yarn F′ causes the yarn to be taut between the point of withdrawal Ap and the withdrawal eyelet 10. This taut yarn holds the stop-motion eyelet 11 in the position shown in FIG. 1 against the force of the spring which acts on the eyelet. In this position, the eyelet 11 is positioned coaxially relative to the withdrawal eyelet 10.

If the withdrawal tension is reduced, for example because the textile machine does not require as much yarn as the yarn feeding device is feeding, or because the yarn is jammed somewhere along the path between the yarn feeding device and the textile machine due, for example, to dirt or lint in the yarn guide element at the working station in question of the textile machine, or because a tangle formed between the yarn package and the yarn feeding device becomes untangled between the yarn feeding device and the working station, the tendency of the unwinding yarn F′ to travel along the withdrawal rim 1*a* opposite the direction of rotation P due to the withdrawal tension not only stops, but also reverses, so that the drum 1 pulls the unwinding yarn F′ along a bit in the sense of rotation P. As is shown in FIG. 2, the yarn F′ thus leaves the hook 15 and escapes laterally. The point of withdrawal, i.e. the location at which the yarn F′ passes over the withdrawal rim 1*a*, moves along the withdrawal rim 1*a* and reaches the location A*p*′ shown in FIG. 2. The unwinding yarn F′ extends between the point of withdrawal A*p*′ and the withdrawal eyelet 10. The point of withdrawal A*p*′ is displaced along a circle defined by the withdrawal rim 1*a* in the same direction in which the spring attempts to urge the eyelet 11. The displacement of the yarn withdrawal point thus coacts with the spring force to pivot the eyelet 11 into the position shown in FIG. 2, in which it causes stopping of the textile machine, by activating the switch 17 as explained hereinafter.

Figure 1:
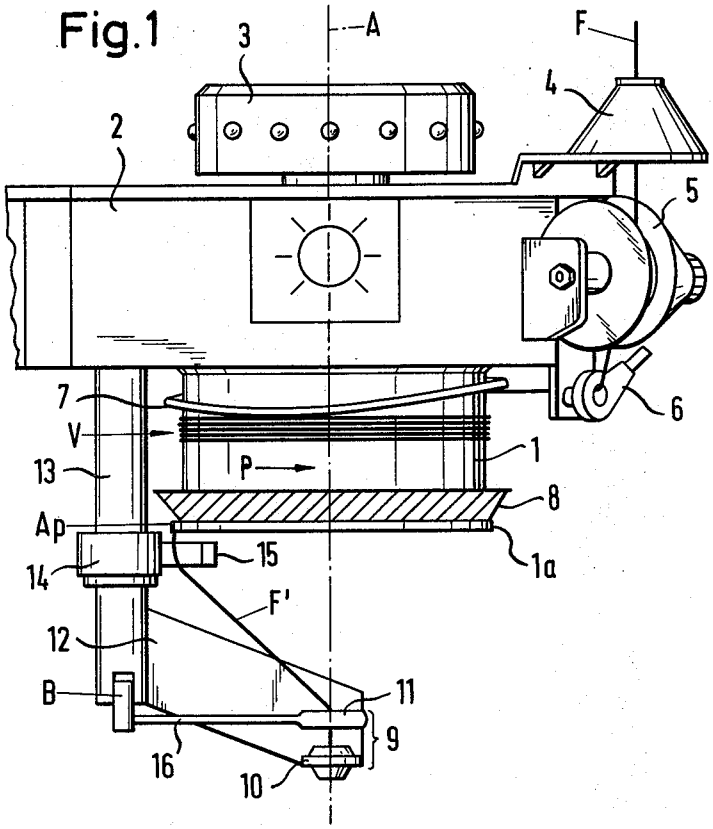
FIG. 1 shows a side elevation of a positive yarn feeding device in a position during normal positive feeding.

According to the invention, in each yarn feeding device arranged on the textile machine, for example of the kind shown in FIGS. 1 and 2, there is now provided an electric circuit for achieving that all output stop motion devices when being released are traversed just by the positive half-cycles or just by the negative half-periods of the current from a central alternating current source, and moreover there are provided centrally arranged electric means for central blocking of the positive or negative half-cycles of said current.

Figure 3:
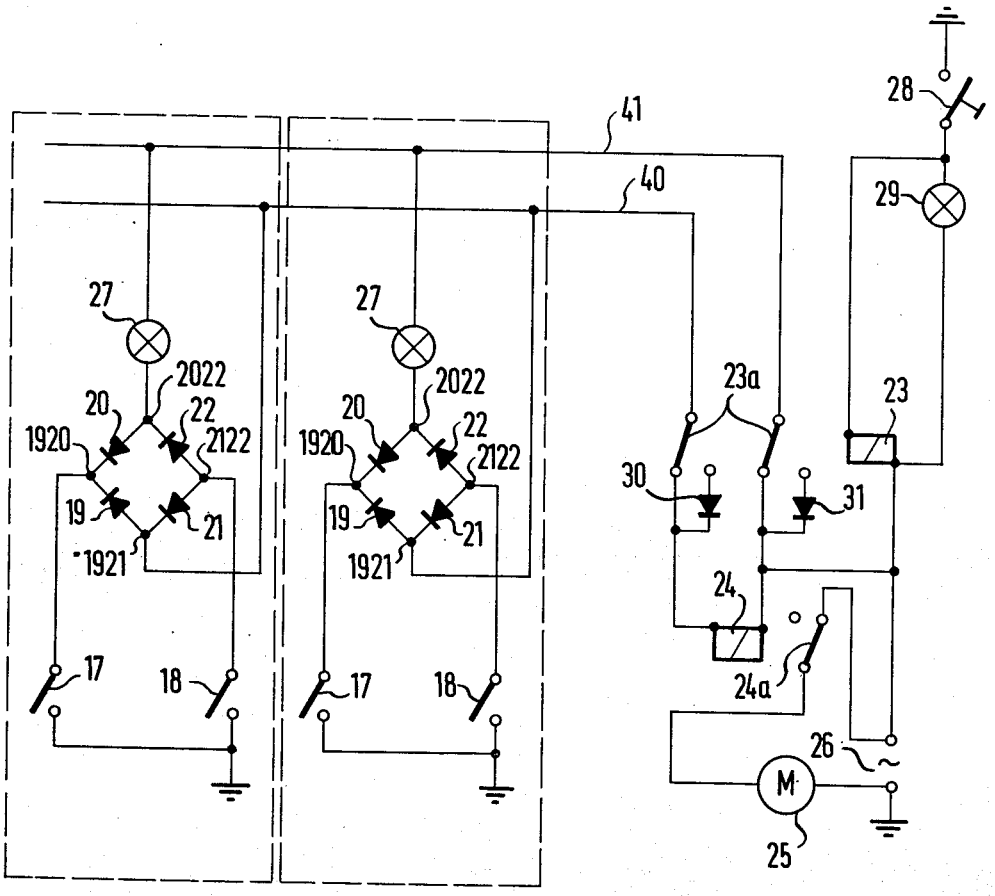
FIG. 3 shows the electric circuit diagram of a control device according to the present invention.

In each such circuit, of which two are shown in FIG. 3, there is like the known case, mentioned in the introductory part, the switches 17 and 18 associated respectively with a first yarn stop motion device, here serving as the output stop motion device 11 in FIGS. 1 and 2, and a second yarn stop motion device, here serving as input stop motion device 6 in FIGS. 1 and 2, whereby one contact terminal of both stop motion devices is connected to ground. According to the present invention the switches 17 and 18 are connected to different terminals 1920 and 2122 respectively on the "direct current side" of a diode rectifier bridge of a kind known per se, comprising the four diodes 19, 20, 21 and 22. The one terminal 1921 on the "alternating current side" of the diode bridge is connected to a bus 40 which is then connected through the switch 23*a* of a relay coil 23, centrally arranged in the machine, and through coil 24 of another relay, the switch 24*a* of which is contained in the ordinary stop motion circuit 25 of the machine, to one terminal of an alternating current source 26. To the same terminal of the alternating current source the other terminal 2022 on the "alternating current side" of the diode bridge is connected via an indicator lamp 27 and bus 41. The relay coil 23 is connected with one of its terminals to the alternating current source 26 and its other terminal can be connected to ground through a manual switch 28 within ease reach on the machine. An indicator lamp 29 preferably located close to the switch 28 is connected in parallel with the coil 23 and shows thereby when the switch 28 is closed.

In the normal case, when it is desired that release of the output stop motion switch 17 as well as of the input stop motion switch 18 shall imply an immediate stop of the driving motor of the machine, the manual switch 28 is put into the position shown in FIG. 3, whereby the coil 23 as well as the indicator lamp 29 is currentless. The terminal 1921 of the diode bridge and the indicator lamp 27 will thereby be directly connected to one terminal of the coil 24 and one terminal of the alternating current source 26 respectively, whereby the positive as well as the negative half-cycles of the alternating current can run through the control device via the output stop motion switch 17 and the input stop motion switch 18 respectively. The relay coil 24 will then thus be activated, and thereby the driving motor of the machine will be stopped, when the output stop motion device 11 or the input stop motion 6 or both are released.

If, on the other hand, the manual switch 28 is closed by the machine operator, the relay coil 23 will be activated, whereby the terminal 1921 of the diode bridge and the indicator lamp 27 will no longer directly but instead via diodes 30 and 31 respectively (centrally arranged in the machine) be connected to one terminal of the coil 24 and the alternating current source 26 respectively. The diodes 30 and 31 prevent passage therethrough of the positive half-cycles of the alternating current with the result that release of the output stop motion, which as we know only can be traversed by the positive half-cycles of the alternating current, does not imply any activation of the relay coil 24 and thereby nor any stopping of the driving motor of the machine. Nor will the indicator lamp 27 light in this case. On the other hand, the negative half-cycles of the alternating current will still be able to traverse the control device implying that release of the input stop motion just as before will involve activation of the relay 24, attendant stopping of the driving motor of the machine and lighting of the indicator lamp 27.

Necessary supplement components to achieve the possibility according to the invention to put one stop motion device temporarily out of operation are, as you will see, extremely few in number and furthermore very simple. As diode circuits 19, 20, 21 and 22 for instance any of the enclosed diode rectifier bridges being on the market can be used, which, of course, offers great advantages as far as assembling is concerned.

This invention is in no way limited to the above described embodiment but many alternatives are possible within the scope of the following claims. It is for example easy to realize that the same result as above is received, if reverse polarity is applied for the diodes 19, 20, 21 and 22 in the bridge as well as for the diodes 30 and 31. The output stop motion switch 17 will then only be traversed by the negative half-cycles of the current, whereas only the positive half-cycles will get through the input stop motion switch 18. The diodes 30 and 31 will in this case prevent passage of the negative half-cycles of the alternating current.

It is also easy to realize that the invention is just as usable, when there is a desire to put the input stop motion device out of operation. This is simply achieved either contrary to what is shown in FIG. 3, by letting the terminal that is not grounded of the input stop motion switch 18 be connected to the terminal 1920 of the diode bridge, with the polarity of the diodes 30 and 31 maintained, whereas the terminal that is not grounded of the output stop motion switch 17 is instead connected to the terminal 2122 of the diode bridge, or by turning the diodes 30 and 31 with maintained connection of the output stop motion switch 17 and the input stop motion switch 18 to the terminal 1920 and the terminal 2122 respectively of the diode bridge.

Furthermore, it ought to be mentioned that the control relay 23 with the control circuit components belonging to it in the form of the indicator lamp 29 and the switch 28 of course can be replaced with a completely manual switch, whereby a control solution is achieved which is simpler in its construction, though less elegant.

I claim:

1. A control device for a textile machine, in particular for a knitting machine having at least one yarn feeding device, each yarn feeding device being provided with two stop-motion devices each respectively having one electrical stop-motion switch, and a relay connected to all stop-motion switches for stopping the mechanical drive of the textile machine, wherein the stop-motion switches of the yarn feeding device are connected to an a-c voltage supplied rectifier circuit in such a manner that the two stop-motion switches of the yarn feeding device are supplied with voltage half-waves of different polarity, and wherein a control unit is provided which is common to all stop-motion switches and which is capable of suppressing voltage half-waves of one polarity in order to neutralize the stop-motion switch supplied with the voltage half-waves of said one polarity with reference to said relay which stops the mechanical drive of the textile machine.

2. A control device according to claim 1, wherein there is a plurality of said yarn feeding devices associated with the knitting machine and each having two stop-motion switches associated therewith, wherein each of the two stop-motion switches of each yarn feeding device is connected to an electrical control line common to all yarn feeding devices through a separate first diode, said first diodes having different polarities and being at least part of the rectifier circuit associated with the respective yarn feeding device, and wherein there is provided a second diode adapted to be connected in said common control line.

3. A control device according to claim 2, wherein each yarn feeding device has associated therewith an indicating lamp having one terminal thereof connected to each of the two stop-motion switches associated with the respective yarn feed device through a separate third diode, said third diodes being bridge-connected with said first diodes so as to form said rectifier circuit, wherein the other terminal of said indicating lamp is connected to a second electrical control line which is common to all yarn feeding devices, and wherein there is provided a fourth diode adapted to be connected in said second control line and polarized so as to conduct therethrough half-waves of the same polarity as the second diode.

4. A control device according to claim 3, wherein there is provided relay means having switch means associated therewith for selectively connecting said second and fourth diodes in said first-mentioned and second control lines respectively, and wherein said relay means is disposed in a circuit including a manually operable switch.

5. A control device according to claim 4, wherein there is provided an indicating lamp connected in parallel to said relay means.

* * * * *